US008002599B2

(12) United States Patent
Grabe et al.

(10) Patent No.: US 8,002,599 B2
(45) Date of Patent: Aug. 23, 2011

(54) SYSTEMS AND METHODS FOR UNDERWATER DESCENT RATE REDUCTION

(75) Inventors: Zachary A. Grabe, West Palm Beach, FL (US); Jason B. Crawford, Wellington, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 185 days.

(21) Appl. No.: 12/544,015

(22) Filed: Aug. 19, 2009

(65) Prior Publication Data

US 2011/0041754 A1 Feb. 24, 2011

(51) Int. Cl.
*B63B 22/14* (2006.01)

(52) U.S. Cl. ..... 441/10; 441/22

(58) Field of Classification Search ..... 441/10, 441/21, 22

See application file for complete search history.

(56) References Cited

U.S. PATENT DOCUMENTS 3,047,259 A * 7/1962 Tatnall et al. ..... 244/138 A
3,114,315 A * 12/1963 Trump ..... 102/388
3,371,643 A * 3/1968 Dunham ..... 114/295
3,944,964 A 3/1976 Loeser et al.
3,978,790 A 9/1976 Sandelius
4,004,309 A * 1/1977 Gongwer ..... 114/312
4,096,818 A 6/1978 Wameling
4,189,703 A 2/1980 Bennett
4,209,151 A 6/1980 Saunders
4,699,333 A 10/1987 Pinson
5,349,916 A 9/1994 Hillenbrand et al.
5,469,407 A 11/1995 Saunders
5,517,938 A 5/1996 Wood et al.
5,646,366 A 7/1997 O'Connell
6,983,710 B1 1/2006 Shen et al.
7,250,568 B1 * 7/2007 Dow et al. ..... 114/20.1
2004/0229531 A1 11/2004 Driscoll et al.
2007/0297290 A1 12/2007 Vosburgh et al.

* cited by examiner

*Primary Examiner* — Stephen Avila
(74) *Attorney, Agent, or Firm* — Fogg & Powers LLC

(57) ABSTRACT

Systems and methods for underwater descent rate reduction are provided. In one embodiment, a method for underwater descent rate reduction for an underwater delivery vehicle is provided. The method comprises: opening a first valve based on a first hydrostatic pressure to permit water to flow into a first chamber of a hydrostatic pressure driven piston assembly; developing a pressure differential across a piston head separating the first chamber from a second chamber of the hydrostatic pressure driven piston assembly; pushing the piston head into the second chamber to extend a piston rod from the hydrostatic pressure driven piston assembly; and pivoting a deflecting flap downward into a direction of vehicle descent as the piston rod extends.

17 Claims, 5 Drawing Sheets

SYSTEMS AND METHODS FOR UNDERWATER DESCENT RATE REDUCTION

GOVERNMENT LICENSE RIGHTS

The U.S. Government may have certain rights in the present invention as provided for by the terms of Contract No. ISS2007224 awarded by the U.S. Navy.

BACKGROUND

Safely delivering delicate payloads from the ocean surface to the ocean floor is a challenging task. If a delivery vehicle descends too fast and impacts too hard with the ocean floor, instruments carried by the vehicle will be damaged. If the vehicle descends too slow, surface currents may cause it to miss its target. One existing technology is the use of drogue chutes to slow the descent rate of the payload's delivery vehicle. Drogue chutes essentially act as underwater parachutes. However, drogue chutes limit the ability to deploy a payload from the tail end of the vehicle because of the risk of entanglement of the payload with the chute. Further, drogue chutes limit the ability to deploy instruments such as antenna arrays from the vehicle, also due to the risk of entanglements.

For the reasons stated above and for other reasons stated below which will become apparent to those skilled in the art upon reading and understanding the specification, there is a need in the art for improved systems and methods for improved underwater delivery systems.

SUMMARY

The Embodiments of the present invention provide methods and systems for underwater descent rate reduction and will be understood by reading and studying the following specification.

Systems and methods for underwater descent rate reduction are provided. In one embodiment, a method for underwater descent rate reduction for an underwater delivery vehicle is provided. The method comprises: opening a first valve based on a first hydrostatic pressure to permit water to flow into a first chamber of a hydrostatic pressure driven piston assembly; developing a pressure differential across a piston head separating the first chamber from a second chamber of the hydrostatic pressure driven piston assembly; pushing the piston head into the second chamber to extend a piston rod from the hydrostatic pressure driven piston assembly; and pivoting a deflecting flap downward into a direction of vehicle descent as the piston rod extends.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present invention provide systems and methods to safely drop a vehicle carrying a payload (such as sensors or other instruments) to the seafloor such that the impact force with the seafloor will not cause damage to the payload. Embodiments of the present invention act to reduce the terminal velocity of the payload delivery vehicle as it descends through the water column. When the terminal velocity prior to impact is minimal, the magnitude of the impact force is low while the likelihood of survival is high. Further, the delivery vehicle described herein allows for various types of payloads (ex. array cables) to be safely deployed from the tail end of a body as it descends.

Embodiments of the present invention function by increasing the projected area along the perimeter of the delivery vehicle. Increasing the projected area along the perimeter causes a reduction in terminal velocity, there by decreasing the magnitude of the forces associated with impact of the vehicle with the seafloor.

Figure 1:
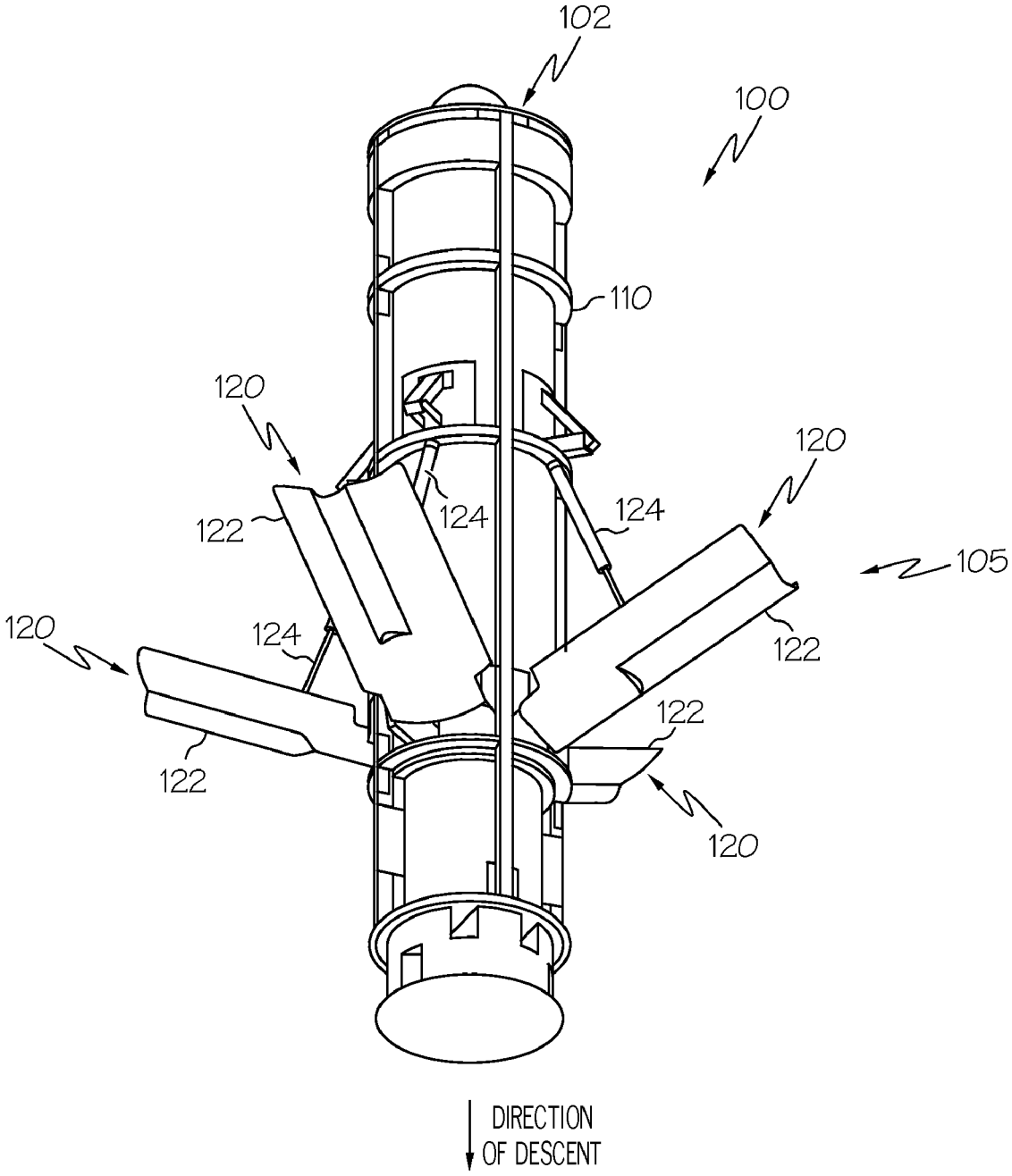
FIG. 1 is a diagram of an underwater delivery vehicle employing an underwater descent rate reduction system of one embodiment of the present invention.

FIG. 1 is a diagram illustrating an underwater delivery vehicle 100 having a velocity reduction system 105 of one embodiment of the present invention. Delivery vehicle 100 comprises a housing body 110 and a plurality of flap assemblies 120 coupled about a perimeter of the housing body 110. In one embodiment, housing body 110 contains instruments such as sensors and electronic devices. Each flap assembly 120 includes a deflecting flap 122 pivotally coupled to the housing body 110 and a hydrostatic pressure driven piston assembly 124. As shown in greater detail in FIG. 2 (discussed below), each hydrostatic pressure driven piston assembly 124 further comprises a cylinder member 126 and a piston member 128. The hydrostatic pressure driven piston assembly 124 is coupled to the housing body 110 (via a pivoting fastener 127) such that the deflecting flap 122 will pivot downward as the piston member 128 operates by extending outward from the cylinder member 126.

Figure 2:
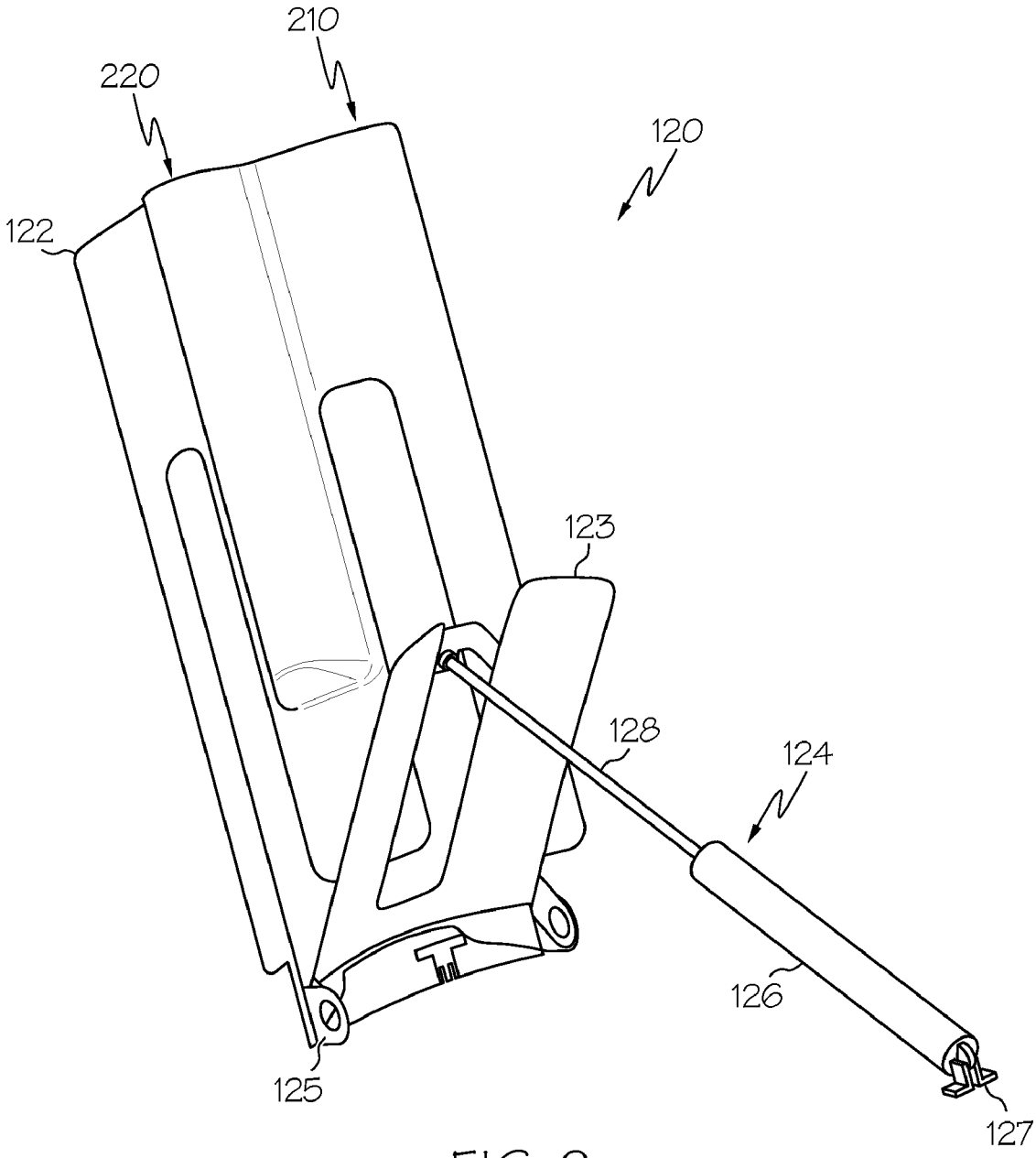
FIG. 2 is a diagram of a flap assembly of an underwater descent rate reduction system of one embodiment of the present invention.

FIG. 2 is a diagram illustrating one embodiment of a flap assembly 120 discussed above in FIG. 1. In one embodiment, each flap assembly 120 comprises a deflecting flap 122, a backing plate 123, a hydrostatic pressure driven piston assembly 124, and a hinge member 125. Deflecting flap 122 and backing plate 123 are both pivotally coupled to hinge member 125, which in turn is mounted to the housing body 110 of vehicle 100. In one embodiment, deflecting flap 122 is manufactured from a fiberglass material while backing plate 123 is manufacture from an aluminum alloy. Piston member 128 of the piston assembly 124 is attached to backing plate 123 (by a clevis or similar fastener, for example) while the cylinder member 126 is attached to a fixed point on the body 110 of vehicle 100. As shown in FIG. 2, in one embodiment piston assembly 124 is coupled to the backing plate 123 rather than directly to deflecting flap 122. This configuration provides support to resists cracking of deflecting flap 122 during operation. When piston member 128 extends, the backing plate 123 distributes the applied force across deflecting flap 122. Backing plate 123 also provides structural support to the deflecting flap 122 against drag forces associated with vehicle 100 falling to the ocean floor.

Figure 3:
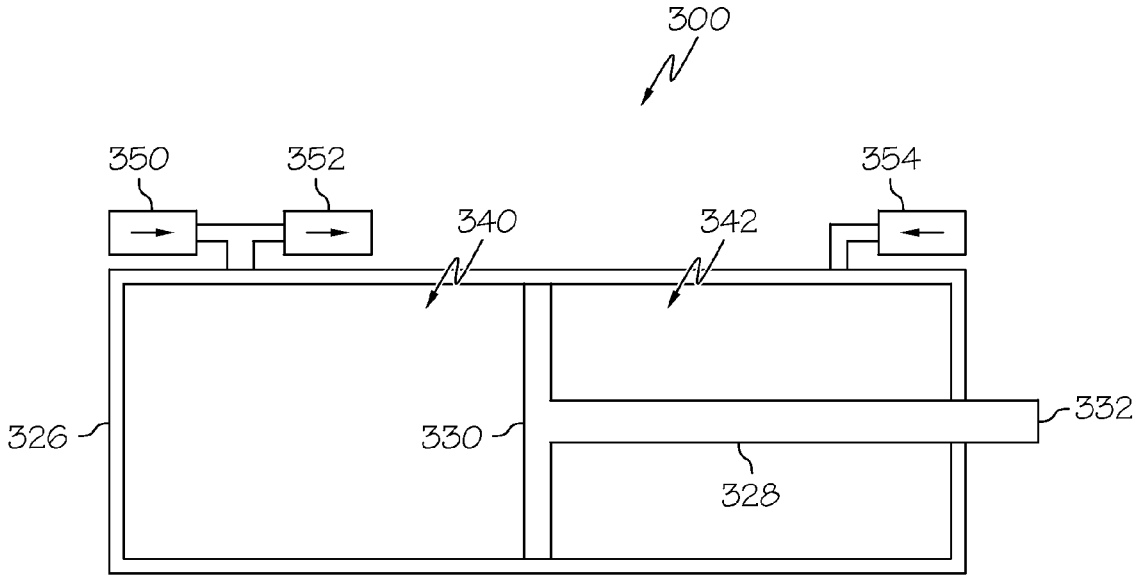
FIG. 3 is a diagram of a hydrostatic pressure driven piston assembly of an underwater descent rate reduction system of one embodiment of the present invention.

FIG. 3 is a diagram of a hydrostatic pressure driven piston assembly 300 of one embodiment of the present invention. In one embodiment, the hydrostatic pressure driven piston assembly 124 described in FIGS. 1 and 2 functions as described with respect to FIG. 3. Hydrostatic pressure driven piston assembly 300 comprises a piston member 328 and cylinder member 326. Piston member 328 comprises a piston head 330 and a piston rod 332. Cylinder member 326 comprises a water chamber 340 and a gas chamber 342, separated by piston head 330 which is moveable within cylinder member 326. In one embodiment, gas chamber 342 contains a compressible gas, such as but not limited to air. In one embodiment, when at sea level, the pressure of the gas within gas chamber 342 is one atmosphere. Water chamber 340 includes at least one hydrostatic pressure operated check valve 350 that opens to allow water from the external environment to flow into water chamber 340 at a predetermine hydrostatic pressure.

In one embodiment, water chamber 340 may further include a safety relief check valve 352. The purpose of check valve 352 is to act as a safety relief in the event that hydrostatic pressure driven piston assembly 300 is no longer exposed to high pressure (for example, brought back towards the surface of the ocean).

In one embodiment, gas chamber 342 includes a check valve 354. The purpose of check valve 354 is to prevent implosion of cylinder member 326 once piston member 328 is fully extended. During extension of piston member 328, gas located in gas chamber 342 compresses and builds pressure. Once maximum extension of piston member 328 is achieved, the gas no longer compresses. However, the hydrostatic pressure outside of cylinder member 326 will continue to increase as the system descends through the water column. At some depth the pressure differential across the wall of the cylinder will be great enough to cause the cylinder member 326 to implode. Check valve 354 is set to allow water to enter gas chamber 342 to prior to this event.

In one embodiment, check valve 350 is set to the lowest cracking pressure of the three check valves (350, 352 and 354). For example, a cracking pressure of 10 psi would start to let water in at a depth of 22 ft. If the hydrostatic pressure driven piston assembly 300 is taken to a depth where the hydrostatic pressure is 460 psi, then the pressure inside water chamber 340 would be 450 psi (that is, 460 psi local hydrostatic pressure minus the 10 psi check valve cracking pressure). If the piston assembly 300 was then brought back to the surface (having a hydrostatic pressure of 0 psi), the outside pressure would no longer be present, but high pressure would still be trapped inside water chamber 340. In this situation a large pressure differential across the wall of cylinder member 326 exists. If cylinder member 326 is not rated for this pressure differential, then it could possibly rupture, causing the cylinder to fail. But with the use of safety relief check valve 352, the pressure in water chamber 340 will relieve to the cracking pressure set to safety relief check valve 352. This ensures that a pressure differential greater than the rating of the cylinder member 326 will not occur. For example, if safety relief check valve 352 has a cracking pressure of 250 psi and piston assembly 300 was brought up from 460 psi to the surface, the pressure inside water chamber 340 will reduce from 450 psi to 250 psi.

In operation, in one embodiment, vehicle 100 is deployed such as from the ocean surface. One of ordinary skill in the art upon reading this specification would appreciate that vehicle 100 may alternately be initially deployed at some initial depth, such as from a submarine. As vehicle 100 descends through the water column, the hydrostatic pressure on vehicle 100 increases as a function of depth. Once a predetermined depth is reached, one or more check valves (such as check valve 350) on each hydrostatic pressure driven piston assembly 124 allows water to flow into water chamber 340, building up water pressure on one side of piston head 330.

A pressure difference builds inside cylinder member 326 causing the piston rod 332 to extend from cylinder member 326. More specifically, the hydrostatic pressure within water chamber 340 pushing on piston head 330 exceeds the gas pressure in gas chamber 340 pushing on piston head 330. The resulting pressure difference pushes piston head 330 into gas chamber 342 which causes piston rod 332 to extend from cylinder member 326. Because piston rod 332 is coupled directly to backing plate 123, this extension causes the deflecting flap 122 panels to pivot downward, out away from the housing body 110, and into the oncoming flow of water. Once deployment has been initiated, a deflecting flap 122 cannot recess back into the body 110 because the check valve 350 stops any flow of water out of water chamber 340. Because each deflecting flap 122 is surrounded on all sides by the static water pressure of the ocean, operation of piston member 328 need only counter the hydrodynamic force from water flow across the deflecting flap 122 in order to drive the deflecting flap 122 into an open position. The force necessary to overcome the hydrodynamic forces is readily provided by the piston member 328 from hydrostatic pressure pushing against the piston head 330 within water chamber 340. Upon maximum extension of piston rod 332 (i.e., at deep depths), check valve 354 opens and allows water to fill the gas chamber 342.

Deployment of each deflecting flap 122 increases the total projected area of the vehicle 100, thus reducing its terminal velocity and impact force on the seafloor. The increase in projected area has a direct relationship with the terminal velocity of the system. As the term is used herein, causing a deflecting flap 122 to pivot "downward" means that the outward facing surface of the deflecting flap 122 rotates to face the direction of vehicle 100's descent and thus face away from vehicle 100's tail end 102.

Because the deflecting flaps are attached about the perimeter of the delivery vehicle's body, the area behind the tail end of the delivery vehicle is free from obstructions. This invention also allows for the deflecting flaps to be deployed at a predetermined water depth. By adjusting the cracking pressure (i.e., the operating pressure) of the check valve 350 of the hydrostatic pressure driven piston assembly, a specified hydrostatic pressure will cause check valve 350 to open, thus initiating the velocity reduction. This feature is advantageous as it allows a falling body to quickly descend through surface currents. Surface currents tend to have a higher velocity magnitude than bottom currents and can cause falling objects to drift off course. Embodiments of the present invention allow a delivery vehicle to thus more accurately hit a target location on the seafloor as it can quickly descend past these surface currents. The velocity is then reduced prior to impact. One advantage of the embodiments described above is that they operate on hydrostatic pressure to generate the force required to activate the flap system and thus do not need to rely on the activation of any electrical components. If after deployment, the need arises to retrieve vehicle 100 from the ocean floor, check valve 352 will vent water chamber 340 during the assent as described above. In one embodiment, high pressure within gas chamber 342 will also decrease from operation of check valve 352 as volume within gas chamber 342 increases due to the travel of piston member 328 back towards water chamber 340.

Figure 4:
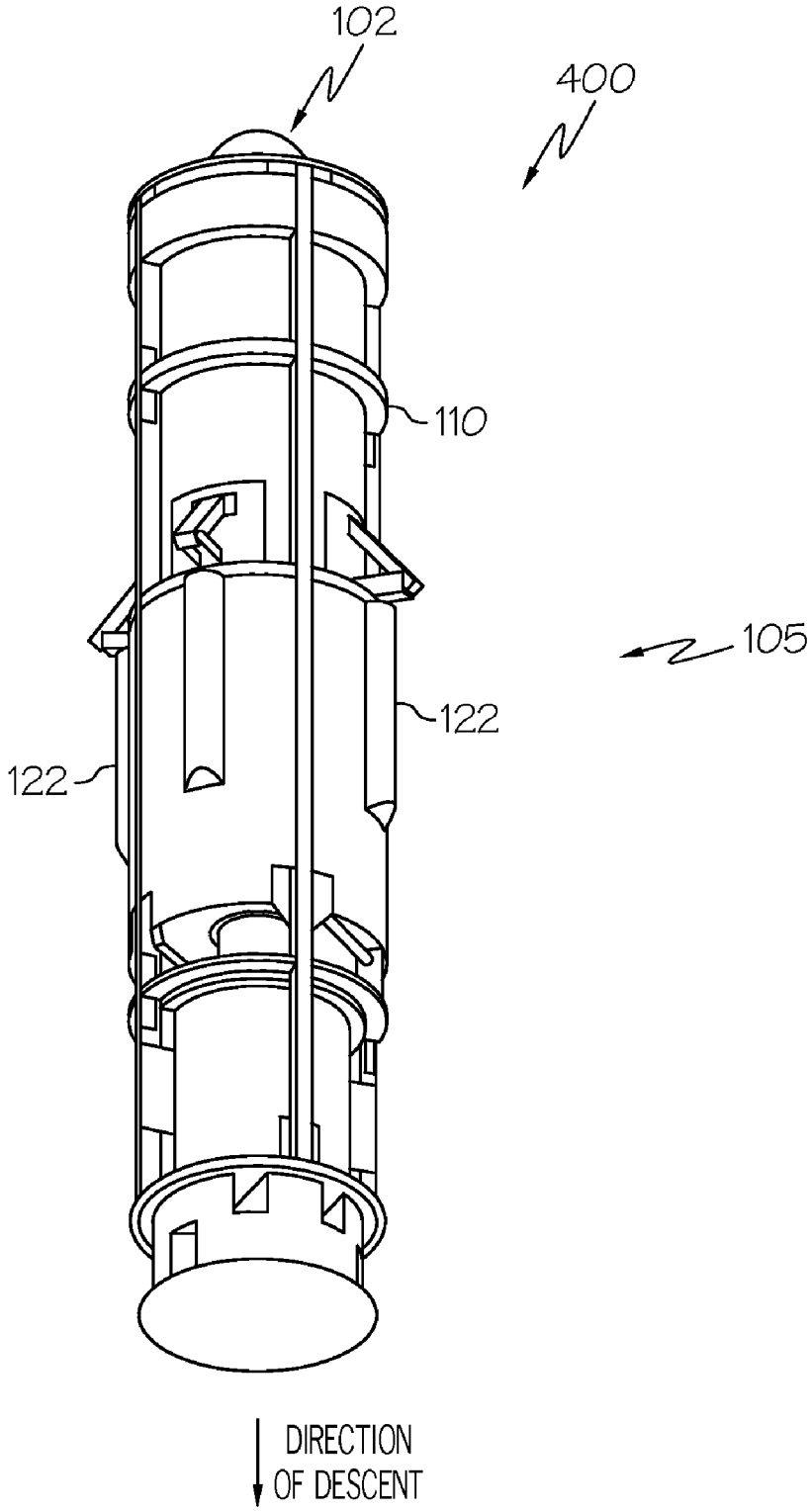
FIG. 4 is a diagram of an underwater delivery vehicle employing an underwater descent rate reduction system of one embodiment of the present invention.

In one embodiment, the deflecting flaps are curved (as shown generally at 210 in FIG. 2) to match the profile of the vehicle body. This reduces drag when the flap assemblies are in the closed position (shown generally in FIG. 4 at 400). By having the closed deflecting flaps hug the body of the vehicle, spinning of the vehicle during descent is avoided. In one embodiment, the profile of the deflecting flap is further curved (as shown generally at 220 in FIG. 2) to accommodate enclosure of a piston assembly 124 prior to flap deployment.

The rate of deployment of the deflection flaps is largely application specific, but can be readily determined by one of ordinary skill in the art upon reading this specification. The configuration shown in FIG. 1 provides for a large angle of deflection initially but the angle increases at a slower rate as descent continues. For example, in one embodiment, the deflection fins will be 75% deployed by 200 feet after reaching the check valve activation depth and 95% deployed at 400 ft. Factors to be considered when designing a rate of deployment curve include the weight of the vehicle, how quickly the vehicle should arrive at the ocean floor, and the projected area of the deflection flaps as they are deployed over the descent. The hydrostatic pressure setting of the hydrostatic pressure driven piston assembly (i.e., the check valve operating point) will determine the depth at which deployment of the deflecting flaps will begin. In addition, the deflection flap thickness should be chosen so that the flaps will survive descent without cracking due to hydrodynamic flow forces. Each of these factors can be readily determined for a particular application by one of ordinary skill in the art upon studying the teachings of this specification.

The flap assembly described above also employs a "breakaway" design wherein the deflecting flaps will flip forward upon reaching the ocean floor, to prevent the vehicle from being driven into the ocean floor. As the vehicle descends and the deflecting flaps open downward, water behind each flap is also moving along with the vehicle. When the vehicle hits the ocean floor and suddenly stops moving, the momentum of the moving water behind the flaps continues to push against the flaps. If the opened deflecting flaps were rigidly attached to the piston assembly, the force from the moving water would drive the vehicle into the ocean floor. Instead, with a flap assembly of the present invention, when the vehicle hits the ocean floor, the deflecting flaps are free to separate from the backing plate and independently pivot forward, deflecting the force of the moving water to the ocean floor. Diverting the moving water avoids applying additional load on the vehicle that would tend to push it further into the ocean floor.

Figure 5:
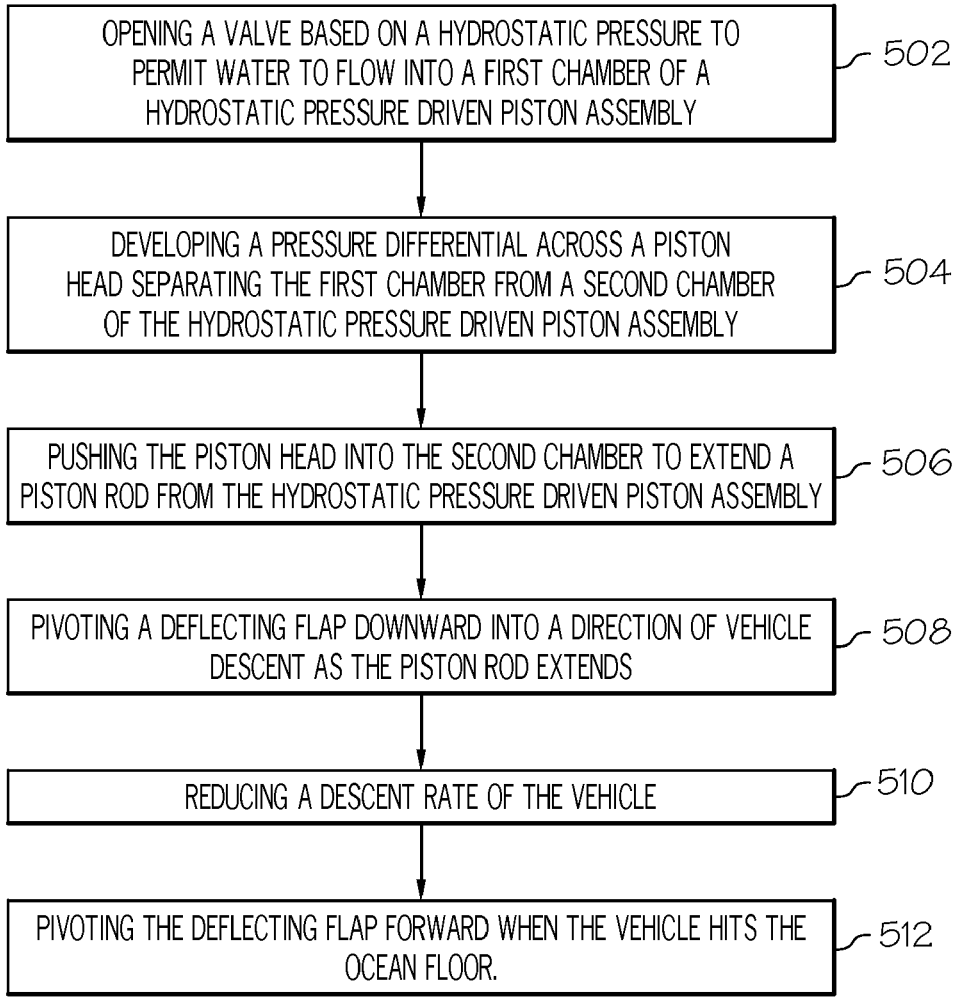
FIG. 5 is a flow chart illustrating a process of one embodiment of the present invention.

FIG. 5 is a flow chart illustrating a method for underwater descent rate reduction for a vehicle of one embodiment of the present invention. The method begins at 502 with opening a valve based on a hydrostatic pressure to permit water to flow into a first chamber of a hydrostatic pressure driven piston assembly. In one embodiment, the hydrostatic pressure driven piston assembly comprises a piston member having a piston head and a piston rod, and cylinder member. The cylinder member comprises a first chamber and a second chamber that are separated by the piston head. The piston head is moveable within the cylinder member. In one embodiment, the first chamber includes at least one hydrostatic pressure operated check valve that opens to allow water from the external environment to flow into the first chamber at a predetermine hydrostatic pressure. The method thus proceeds to 504 with developing a pressure differential across a piston head separating the first chamber from a second chamber of the hydrostatic pressure driven piston assembly. In one embodiment, the second chamber is a gas chamber that contains a compressible gas, such as but not limited to air. The method proceeds to 506 with pushing the piston head into the second chamber to extend a piston rod from the hydrostatic pressure driven piston assembly. The method proceeds to 508 with pivoting a deflecting flap downward into a direction of vehicle descent as the piston rod extends.

Deployment of each deflecting flap by pivoting the flap downward increases the total projected area of the vehicle, thus reducing its terminal velocity and impact force on the seafloor. The increase in projected area has a direct relationship with the terminal velocity of the system. The method thus proceeds to 510 with reducing a descent rate of the vehicle. Because the deflecting flap is opened downward into the direction of descent, the flow of water across the deflecting flap creates hydrodynamic forces that will resist further opening of the flap. The force necessary to overcome these hydrodynamic forces is readily provided by hydrostatic pressure developed within the hydrostatic pressure driven piston assembly. In one embodiment, once deployment has been initiated, a deflecting flap will not recess back into a closed position because the check valve stops any flow of water out of the first chamber of the hydrostatic pressure driven piston assembly.

As the vehicle descends and the deflecting flaps open downward, water behind each flap is also moving along with the vehicle. When the vehicle hits the ocean floor and suddenly stops moving, the momentum of the moving water behind the flaps continues to push against the flaps.

To prevent the vehicle from being driven into the ocean floor, in one embodiment the method proceeds to 512 with pivoting the deflecting flap forward when the vehicle hits the ocean floor. In one embodiment, pivoting the deflecting flap forward when the vehicle hits the ocean floor comprises separating the deflecting flap from the hydrostatic pressure driven piston assembly when the vehicle hits the ocean floor. That is, the deflecting flaps are free to separate from the hydrostatic pressure driven piston assembly and independently pivot forward, deflecting the force of the moving water to the ocean floor. Diverting the moving water, avoids applying additional load on the vehicle that would tend to push it further into the ocean floor.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. An underwater delivery vehicle, the vehicle comprising:

a housing body; and a plurality of flap assemblies coupled about a perimeter of the housing body, each flap assembly including a deflecting flap pivotally coupled to the housing body and a hydrostatic pressure driven piston assembly having a cylinder member and a piston member;

wherein the hydrostatic pressure driven piston assembly is coupled to the housing body and causes the deflecting flap to pivot downward when the piston member extends from the cylinder member;

each of the plurality of flap assemblies further comprising a backing plate pivotally coupled to the deflecting flap by a hinge member that is mounted to the housing body;

wherein the deflecting flap is free to independently pivot about the hinge member between the backing plate and the housing body.

2. The vehicle of claim 1, wherein the piston member is pivotally coupled to the backing plate and the cylinder member is pivotally coupled to the housing body.

3. The vehicle of claim 1, the cylinder member of the hydrostatic pressure driven piston assembly comprising a water chamber and a gas chamber separated by a movable piston head of the piston member;

the water chamber including a first hydrostatic pressure operated check valve that opens to allow water to flow into the water chamber at a predetermine hydrostatic pressure.

4. The vehicle of claim 3, wherein the water chamber includes a second hydrostatic pressure operated check valve that opens to allow water to flow out from the water chamber at a predetermine hydrostatic pressure.

5. The vehicle of claim 3, wherein a pressure differential between the gas chamber and the water chamber caused by water flowing into the water chamber moves the piston head such as to extend a piston rod of the piston member out from the cylinder member.

6. The vehicle of claim 3, wherein the gas chamber includes a third hydrostatic pressure operated check valve that opens to allow water to flow into the gas chamber at a predetermine hydrostatic pressure, wherein the third hydrostatic pressure operated check valve operates at a higher pressure than the first hydrostatic pressure operated check valve.

7. The vehicle of claim 3, wherein a water pressure in the water chamber applies a force to the movable piston head that extends a piston rod from the cylinder member, wherein extension of the piston rod from the cylinder member operates the deflection flap to pivot downward.

8. The vehicle of claim 1, wherein the deflection flap is curved to match a profile of the housing body when the deflection flap is in a closed position.

9. A method for underwater descent rate reduction for an underwater delivery vehicle, the method comprising:

opening a first valve based on a first hydrostatic pressure to permit water to flow into a first chamber of a hydrostatic pressure driven piston assembly;

developing a pressure differential across a piston head separating the first chamber from a second chamber of the hydrostatic pressure driven piston assembly;

pushing the piston head into the second chamber to extend a piston rod from the hydrostatic pressure driven piston assembly;

pivoting a deflecting flap downward into a direction of vehicle descent as the piston rod extends; and opening a second valve based on a second hydrostatic pressure to permit water to flow into the second chamber of the hydrostatic pressure driven piston assembly, wherein the second valve operates at a greater hydrostatic pressure than the first valve.

10. The method of claim 9, wherein opening the first valve based on a first hydrostatic pressure further comprises opening a first check valve at a predetermined depth, based on a hydrostatic water pressure surrounding the vehicle.

11. The method of claim 9, wherein the hydrostatic pressure driven piston assembly comprises a cylinder member and piston member, the piston member having a piston head located within the cylinder member and a piston rod.

12. The method of claim 9, further comprising:

opening a third valve to allow water to flow out from the water chamber at a predetermine hydrostatic pressure.

13. The method of claim 9 further comprising reducing a descent rate of the vehicle.

14. The method of claim 9 further comprising pivoting the deflecting flap forward when the vehicle hits the ocean floor.

15. The method of claim 14, wherein pivoting the deflecting flap forward when the vehicle hits the ocean floor comprises separating the deflecting flap from the hydrostatic pressure driven piston assembly when the vehicle hits the ocean floor.

16. An underwater descent rate reduction system, the system comprising:

at least one flap assembly, the flap assembly including a deflecting flap pivotally coupled to a hinge member, a backing plate pivotally coupled to deflecting flap via the hinge member, and a hydrostatic pressure driven piston assembly having a cylinder member and a piston member;

wherein the hydrostatic pressure driven piston assembly is coupled between a vehicle housing body and the backing plate and causes the deflecting flap to pivot about the hinge member in a downward direction with respect to the vehicle housing body when the piston member extends from the cylinder member;

the cylinder member of the hydrostatic pressure driven piston assembly comprising a water chamber and a gas chamber separated by a movable piston head of the piston member; and the water chamber including a hydrostatic pressure operated check valve that opens to allow water to flow into the water chamber at a predetermine hydrostatic pressure, wherein a pressure differential between the gas chamber and the water chamber moves the piston head to extend the piston member from the cylinder member.

17. The system of claim 16, wherein the deflection flap is curved to match a profile of the vehicle housing body when the deflection flap is in a closed position.

* * * * *